United States Patent [19]

Pirgov et al.

[11] 3,994,410

[45] Nov. 30, 1976

[54] PLASTIC BOTTLE CAP

[75] Inventors: Yordan Vassilev Pirgov; Dimiter Yordanov Penkin; Margarita Ilieva Pirgova, all of Sofia, Bulgaria

[73] Assignee: So Besalkoholni Na Pitki I Mineralni Vodi, Sofia, Bulgaria

[22] Filed: June 30, 1975

[21] Appl. No.: 591,504

[30] Foreign Application Priority Data

July 1, 1974 Bulgaria ..... 27138

[52] U.S. Cl. ..... 215/320

[51] Int. Cl.[2] ..... B65D 41/30

[58] Field of Search ..... 215/305, 320, 321

[56] References Cited

UNITED STATES PATENTS

| | | | |
|---|---|---|---|
| 2,768,762 | 10/1956 | Guinet | 215/320 |
| 3,556,338 | 1/1971 | Wilkinson | 215/320 |
| 3,722,729 | 3/1973 | Yamada | 215/320 |
| 3,825,144 | 7/1974 | Wiedmer | 215/320 |
| 3,858,742 | 1/1975 | Grussen | 215/320 |

*Primary Examiner*—Ro E. Hart

[57] ABSTRACT

An elastically deformable plastic cap for containers such as bottles having necks, such containers containing materials under pressure, such as aerated liquids. The cap consists of two cylinders disposed concentrically one within the other. The outer cylinder has a sealing ring with a sealing edge at its lower end and the inner cylinder is closed at its bottom end with a diaphragm. The cylinders are connected at their upper ends by means of a ring. The bottom surface of the diaphragm and the bottom surface of the sealing ring are disposed in a first common plane; the sealing edges on the inner surface of the sealing ring and the outer surface of the inner cylinder respectively and the upper surface of the diaphragm lying in a second common plane, the second plane being parallel and above the first common plane. Preferably the inner side wall of the inner cylinder is provided with an annular step, and the inner part of the inner cylinder above the diaphragm and the outer part of the inner cylinder in the plane of the diaphragm are bevelled in the same direction to provide an outwardly and upwardly expanding frusto-conical portion connecting the lower end of the inner cylinder with the outer edge of the diaphragm.

3 Claims, 2 Drawing Figures

Fig. 1
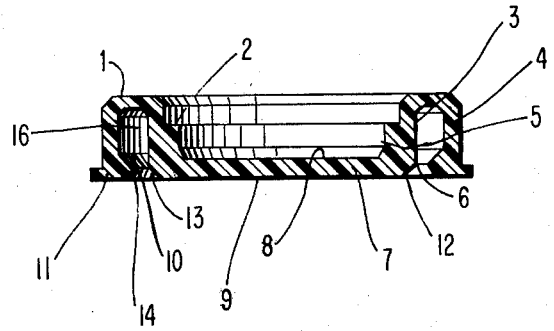
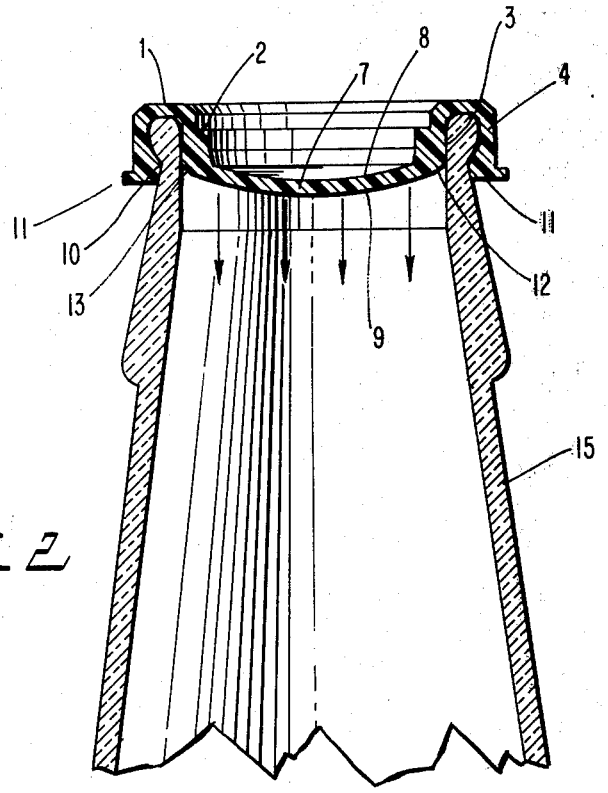
Fig. 2

PLASTIC BOTTLE CAP

This invention relates to an elastically deformable plastic cap for closing bottles containing materials such as aerated liquids under pressure.

A plastic cap for closing bottles containing aerated liquids is known. Such cap consists of two concentrically disposed radially spaced cylinders connected at their upper ends by means of a ring. The inner cylinder of this cap is closed at its bottom end by a diaphragm, there being a sealing ring in the other end of the outer cylinder. However, the inner ring of this cap does not end in the plane in which the sealing ring of the outer cylinder is disposed. Because of the high pressure inside the bottle, the inner cylinder of the cap is returned unwardly and provides a formation whereby it is attached to the rim of the neck of the bottle or other container. This reduces the sealing of the inner cylinder to the neck of the container, and leads to a reduction of pressure by leakage of the pressure produced as a result of the aeration of liquid contained in the bottle.

Furthermore, the inner cylinder of this cap has a standard uniform wall thickness. Because of this, if the cap is placed on a bottle the diameter of which deviates from the normal diameter, the upper ring, which connects the outer and the inner cylinders, cannot reduce its diameter, while the inner cylinder is forced to fold and the sealing between the inner wall of the neck of the bottle and the cap is disturbed. The shaping of the inner cylinder to have a constant thickness also creates difficulties when the caps are placed onto the neck of bottles with deviations in the diameter of their necks.

It is therefore a general object of the present invention to provide a tight and reliable closure for bottles for liquids under pressure , such bottles having variations in the diameter of the necks thereof.

This object is achieved by the elastically deformable plastic cap of the invention. Such cap comprises two cylinders disposed concentrically one within the other. The outer cylinder has a sealing edge formed at its bottom end, while the inner cylinder is closed at its bottom end by a diaphragm. The two cylinders are connected at their upper ends by a ring.

Distinctive features of the cap of the invention are: The lower end of the inner cylinder of the cap are closed by a diaphragm. The lower surface of the outer sealing ring and of the diaphragm are disposed in a first common transverse plane. An inner sealing edge of the sealing ring and the upper surface of the diaphragm are disposed in a second common plane, the second common plane being disposed parallel to and above the first common plane.

To afford facile application of the cap to a bottle or the like, the inner surface of the outer cylinder below the outer sealing ring thereon and the outer surface of the lower end of the inner cylinder below the inner sealing ring are reversely beveled to present a downwardly flared annular opening therebetween. The illustrative cap of the invention makes possible the reliable closing of bottles containing highly aerated liquids, such bottles having necks with diameters lying within the range of 14–17 mm.

For a better understanding of the invention, reference should be made to the accompanying drawings.

In the drawings:

FIG. 1 is a view in vertical axial section through the cap; and

FIG. 2 is a view in vertical axial cross-section of the cap and of the neck of a bottle, the cap being shown as it appears while applied to the neck of the bottle.

The illustrative cap of the invention has an outer cylinder 4 and an inner cylinder 3, the cylinders being connected at their upper ends by means of a ring 1. The The inner cylinder 3 is closed at its bottom end by a diaphragm 7. The bottom surface of the sealing ring 11 which is located at the lower end of the outer cylinder 4 is located in the same horizontal plane as the bottom surface of the diaphragm.

The inner sealing edge 10 of ring 11, the outer sealing edge 13, and the upper surface 8 of the diaphragm 7 also substantially lie in a common plane, such common plane lying above and parallel to the first-mentioned plane. The inner cylinder 3 is provided with an annular step 2 intermediate its vertical dimension, and the inner and outer surfaces of the lower end of the inner cylinder 3 are beveled at 5 and 6, respectively, to provide a walled frusto-conical portion which connects the cylinder proper 3 with the diaphragm, such frusto-conical portion being disposed coaxial of the vertical axis of the cap and expanding in a vertical direction.

To afford easy application of the cap to a bottle neck, the inner surface 14 of the outer cylinder 4 below the sealing edge or root 10 thereon and the outer surface 12 of the lower end of the inner cylinder 3 below the inner sealing edge 13 are reversely beveled to present a downwardly flared annular opening therebetween. The annular space 16 within the relaxed cap shown in FIG. 1 is defined by generally paralled spaced inner and outer circular cylindrical walls above the root 10 of the outer sealing ring 11 and by a generally semi-toroidal downwardly open surface connecting the upper ends of the inner and outer cylindrical walls.

The cap is placed on the neck of a bottle (FIG. 2) in the following manner:

The cap is placed on the upper end of the neck 15 of the bottle coaxially thereof and the plunger (not shown) of a capping device is lowered into engagement with the upper surface of the diaphragm 7. The plunger has a diameter which is less than the diameter of the inner cylinder 3, and has the lower end thereof preferably of curved or part-spherical shape so that as the plunger is lowered to exert a downward pressure upon the diaphragm, 7 as indicated by the arrows, the diaphragm 7 is bent and stretched. This leads to a reduction of the diameter of the inner cylinder 3, so that the cap can be thrust home upon the neck of the bottle into the position shown in FIG. 2. Following this, the plunger is raised so that the diaphragm 7 tends to return to the flat condition thereof, shown in FIG. 1. The pressure of the liquid in the bottle and the elastic deformations of the various parts of the cap produces sealing between the outer surface of the inner cylinder 3 and the inner surface of the upper end of the neck of the bottle, the pressure within the container constantly tending to flatten the diaphragm 7 and thus to increase its diameter. Seals are also produced between the confronting engaging surfaces of the cap which extend from the upper inner surface of the inner cylinder, over the curved upper end of the neck of the bottle and down to the lower end of the inner surface of the outer cylinder 4 down to the sealing edge 10 thereof and beyond. Because the radially inner and outer surfaces at the upper end of the neck 15 of the bottle present a reentrant angle therebetween as shown in FIG. 2, and because the applied cap conforms to such surface, the cap is securely retained in sealing relationship with the neck of the bottle. When the cap is applied to bottles with a smaller diameter of the neck, the sealed part of the inner cylinder 3, which lies above the annular step 2, seats tightly onto the upper rim of the neck of the bottle. Further, under such conditions, the above-described additional sealing existing between confronting surfaces of the bottle neck and the cap, down to and including the sealing edge 10, remains effective.

As shown, the cap is preferably made as a one-piece molding. Illustrative but non-limiting are plastic materials from which the cap may be made, as follows:

- polyethylene, such as that sold under the designations BULEN A-30, groups I and II;
- polyamide, such as that sold under the trade name RISLAN-R-40; and
- ionomer resin such as that sold by duPont under the trademark "SURLYN". (A similar ionomer resin is made and sold in Bulgaria under the trademark "POLYJALOMERE".)

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In an elastically deformable plastic cap forcible downwardly into and over the neck of a bottle containing material under pressure for substantially closing the neck, the cap having two concentric cylinders disposed one within the other, the outer cylinder having a sealing ring with an inwardly projecting sealing edge formed in its lower portion, the inner cylinder being closed at its bottom end by a diaphragm, the two cylinders being connected at their upper ends by means of a ring and defining therebetween an annular area, the improvement in which te diaphragm has a preformed planar shape of substantially constant thickness and extends substantially across the width of the bottle neck when relaxed; in which the lower surface of the sealing ring and the lower surface of the diaphragm are disposed in a first common plane while te diaphragm remains undeformed; in which the inner edge of the sealing ring and the upper surface of the diaphragm are disposed in a second common plane parallel to and disposed above the first common plane while the diaphragm remains undeformed; and in which the diaphragm is deformed by said downward force into a continuous arcuate convex closure which sealingly intersects the inner surface of the bottle neck with the inner surface of the annular area substantially continuously engaging the surface of the bottle neck above the intersection of the neck wall and the arcuately deformed diaphragm, the tightness of the seal increasing in proportion to the upward force exerted on the deformed diaphragm by the pressure in the bottle.

2. A plastic cap according to claim 1, wherein the inner cylinder is provided with an annular step on its intermediate surface disposed intermediate the vertical dimension of the inner cylinder.

3. A plastic cap according to claim 1, wherein the lower end of the inner cylinder proper and the outer edge of the diaphragm are connected by an upwardly and outwardly expanding frusto-conical portion.

* * * * *